United States Patent [19]

Small

[11] Patent Number: 4,815,741

[45] **Date of Patent: * Mar. 28, 1989**

[54] AUTOMATED MARKETING AND GAMING SYSTEMS

[76] Inventor: Maynard E. Small, 105 Ward Pkwy., Apt. 507, Kansas City, Mo. 64112

[ * ] Notice: The portion of the term of this patent subsequent to Jun. 2, 2004 has been disclaimed.

[21] Appl. No.: 34,282

[22] Filed: Apr. 2, 1987

Related U.S. Application Data

[63] Continuation-in-part of Ser. No. 668,011, Nov. 5, 1984, Pat. No. 4,669,730.

[51] Int. Cl.[4] ..... A63F 9/00

[52] U.S. Cl. ..... 273/138 A; 273/1 E

[58] Field of Search ..... 273/1 E, 85 G, 138 A, 273/DIG. 28; 364/410–412

[56] References Cited

U.S. PATENT DOCUMENTS

| | | | |
|---|---|---|---|
| 3,124,674 | 3/1964 | Edwards et al. . | |
| 3,327,292 | 6/1967 | Eriksson et al. . | |
| 3,770,269 | 11/1973 | Elder . | |
| 3,786,234 | 1/1974 | Trent et al. . | |
| 3,787,660 | 1/1974 | Meyers et al. . | |
| 3,909,002 | 9/1975 | Levy . | |
| 3,982,102 | 9/1976 | Cidade . | |
| 4,031,376 | 6/1977 | Corkin, Jr. . | |
| 4,072,930 | 2/1978 | Lucero et al. . | |
| 4,108,361 | 8/1978 | Krause . | |
| 4,322,612 | 3/1982 | Lange . | |
| 4,323,770 | 4/1982 | Dieulot et al. . | |
| 4,339,798 | 7/1982 | Hedges et al. . | |
| 4,373,723 | 2/1983 | Brown et al. . | |
| 4,467,424 | 8/1984 | Hedges et al. . | |
| 4,494,197 | 1/1985 | Troy et al. | 364/412 |
| 4,636,951 | 1/1987 | Harlick | 273/DIG. 28 |
| 4,669,730 | 6/1987 | Small | 273/138 A |

OTHER PUBLICATIONS

Commerce Bank, "Connection 24 Sweepstakes", pamphlet, publication date unknown, but published at least by Aug. 1983.

Supermarket News, "ATMs for Retailers an 'Open Question'", Jul. 23, 1984.

Sweepstakes–Type Game Conducted by Bank in Texas during 1983.

Centerre Bank, "Big Dollar Giveaway", pamphlet, published Oct. 1984.

Crocker National Bank promotion, date unknown.

Union National Bank "Express Cash", Sweepstakes, conducted at least as early as May 1982, in Little Rock, Arkansas.

*Primary Examiner*—Maryann Lastova

*Attorney, Agent, or Firm*—Litman McMahon & Brown

[57] ABSTRACT

An apparatus and method for automated marketing and gaming wherein a player inserts an identification card into an automated remote interface device and accesses an account at a subject financial institution. The user identifier provides access to the financial account, and a user indicia is compared to a game indicia. In one form a sweepstakes processor compares the user and game indicia to determine whether a selected winning correlation is present between the game indicia and user indicia. The appartus is adapted to be used with a network of data processing machines and a transmission facilities device, which provides data processing communication among the data processing machines. The processor can alternatively be in electronic communication with a government-associated lottery system to purchase lottery chances for distribution to users of the remote interface device. Further, the processor can be utilized to allow a user to purchase a lottery ticket electronically through a transfer of funds from the user's financial account to a lottery-type game account.

29 Claims, 4 Drawing Sheets

AUTOMATED MARKETING AND GAMING SYSTEMS

CROSS-REFERENCE TO RELATED APPLICATION

The present application is a continuation-in-part of United States application Ser. No. 668,011, filed Nov. 5, 1984, entitled AUTOMATED SWEEPSTAKES-TYPE GAME, now U.S. Pat. No. 4,669,730.

BACKGROUND OF THE INVENTION

This invention relates to a marketing and gaming apparatus and, more particularly, to devices which, in one form, require the use of a remote computer terminal and data processor for matching certain user indicia with corresponding game indicia.

Sweepstakes-type games are well known, and typically involve the selection of a series of numbers by a player and the comparison of same to a random preselected number determined by the sweepstakes operator. If the numbers match, the player or user is typically awarded a prize, either as pre-determined by the operator or through an alternative random selection process. Previous sweepstakes-type games have required active participation by the user.

In recent decades, significant advancements have been made in the development of computer technology. Such elements have influenced the operation of financial institutions, such as banks and savings and loans associations. It is now commonplace for a financial institution to issue its customers a debit card with a magnetically encoded stripe on the back thereof. The debit card is designed for insertion into a remote computer terminal, such as an automated teller machine (ATM) or point-of-sale (POS) terminal. The remote terminal is in electronic communication with a data processor associated with the financial institution. Upon entry of proper user identifiers, such as a personal identification number (PIN), the user has electronic access to his or her account so that various transactions can be undertaken.

One significant development in the computer field enables a network of participating financial institutions to communicate among themselves such that the customer of one institution can use his or her debit card to execute certain transactions at another participating institution's automated teller machine. These networks are typically known as electronic funds transfer (EFT) systems. To accomplish the routing of a particular customer's transaction to his account with his financial institution, sophisticated data processing machines known as transmission facilities devices, or switches, are utilized. The switch is comparable to a traffic controller in that it routes a specific transaction to its appropriate destination. It is envisioned that with proper computer hardware and software, a user will be able to access his financial account from practically anywhere in the world.

The advantage to the financial institution is that the amount of paperwork is drastically reduced in that no checks or the like are involved. In the case of the POS terminal, the user's financial account is immediately debited in the amount of the user's purchase. Such a system is advantageous to the merchant because the funds are immediately transferred to the merchant's account from the user's account; thus, there is no float time or chance of non-collection of a check. Again, the financial institution saves time and money through the reduction of its paper processing.

Notwithstanding the convenience to the user, the use of debit cards at ATMs and POS terminals has not been as high as the financial institutions require to achieve substantial economic benefit from the machines. Thus, there exists a need for a manner in which to promote the use of the machines, both for the benefit of a financial institution and the associated merchants. Preferably, the promotional scheme should promote the use of the debit cards in addition to promoting the goods and services of the merchants by rewarding the user of the ATM or POS terminal. There further exists a need for a device to promote the debit card use on a broad geographic basis without resorting to active involvement of the user or employees of the financial institution. In order to utilize the machines more fully, there is a need to expand their uses, as by using them to effect the purchase of lottery tickets.

OBJECTS OF THE INVENTION

The principal objects of the present invention are: to provide a game apparatus for encouraging the use of remote financial institution interface devices; to provide such a game apparatus which utilizes a sweepstakes-type game scheme; to provide such a game apparatus which utilizes a sweepstakes game computer in conjunction with a financial institution data processor and a remote interface device; to provide such a game apparatus which can be used in conjunction with a network of financial institution data processors having electronic communication means thereamong; to provide such a game apparatus having means to identify a user of a remote interface device and assign a user-specific indicia thereto for matching to a randomly selected game indicia to determine whether the user wins a prize; to provide such a game apparatus wherein the user indicia is the user's account number with his or her financial institution; to provide such a game apparatus which may be utilized to purchase separately lottery chances by a user; to provide such a game apparatus which uses complimentary lottery chances as an inducement to use the remote interface devices; to provide such a game apparatus which is relatively simple to use, economical to manufacture, requires relatively low labor input, minimal computer time, and user active participation and is particularly adapted for the proposed usage thereof.

Other objects and advantages of this invention will become apparent from the following description taken in conjunction with the accompanying drawings wherein are set forth, by way of illustration and example, certain embodiments of this invention.

SUMMARY OF THE INVENTION

Apparatus and method designed for participation of a user in a marketing or gaming system promotes the use of a remote computer terminal adapted to be in electronic communication with a financial institution. A user interacts with an interface device, such as a remote computer terminal, and more particularly an automated teller machine (ATM) or point-of-sale (POS) terminal. Preferably, a magnetically encoded debit card is inserted into the ATM or POS terminal and the user is required to identify his account through the use of a personal identification number (PIN).

Upon validation of the user's access to the financial institution account, the account number is relayed to a sweepstakes processor. The sweepstakes processor has means for generating a random game indicia, e.g. a game number. The processor is further adapted to compare the account number and the game number and determine whether the two numbers match.

The present invention is designed to be used in conjunction with a network of financial institutions having interconnected data processing facilities. Typically, each separate financial institution has a plurality of ATM, POS terminals or other remote interface devices. In recent years network systems have been developed to allow electronic communications among the various ATMs and POS terminals and the financial institutions such that a user of any of the ATMs can access his personal financial account. A transmission facilities device, commonly known as a switch, is a sophisticated computer facility having the means to route a particular transaction from any of the ATMs or POS terminals to the appropriate financial institution and then relay information back to the ATM or POS terminal. In this way, a user can access his financial account in one city even though the user is in a city located many hundreds or thousands of miles away, so long as the ATM or POS terminal and the individual user's financial institution are on the network.

In order to limit fraudulent access, in addition to the magnetically encoded debit card, each user is assigned a personal identification number, i.e. PIN, which is designed to be kept secret. Typically, only a central holding company has access to the PINs, although the PINs are recorded in each financial institution's computer data banks. Appropriate security limits are placed on access to these computer data banks.

A sophisticated communications network such as the one described is an expensive endeavor. In order to justify the expense, it is vital that the financial institution's customers utilize the system. The financial institutions benefit from the use of the system in that the transactions are essentially paperless and are not labor intensive, resulting in cost savings sufficient to justify the capital outlay. In addition, some financial institutions charge a nominal fee to the user for each transaction using the debit card, in much the same way that check fees are imposed.

It is the purpose of the present invention to stimulate use of the ATMs and POS terminals by providing a sweepstakes-type game which utilizes a network apparatus. Upon insertion of the debit card to an ATM or POS terminal, the user is required to enter the PIN, which validates the user's access to the particular financial institution account. The sweepstakes processor reads the account number or other selected user indicia and compares the account number to a computer-generated prize number. The prize number may be randomly generated instantaneously with the reading of the account number, or one or more winning account numbers can be pre-selected, but preferably on a random basis. In either case, the prize number is compared to the account number and a determination is made as to whether a winning correlation exists between the two numbers. Preferably, an identical match is required between the prize number and account number. Typically, the account numbers are about ten digits in length; thus, a great deal of flexibility is available in terms of the required winning correlation. It is possible that a particular prize could be awarded for matching, for example, five numbers out of ten numbers, whereas a different selected prize could be given for an identical match.

If the account number does not match the prize number, this information is relayed back to the ATM or POS terminal (through the switch if present) and preferably, the user is so notified on a transaction receipt, which is delivered to the user upon completion of the other financial transactions.

If a winning correlation exists, the sweepstakes computer is programmed to determine the prize to be awarded the user. As with the generation of the prize number, it is possible to randomly select a prize each time a winning correlation is encountered. Alternatively, if the winning numbers are pre-selected, it is possible to assign a prize to that number upon generation of same. As a third alternative, the prizes can be awarded in a pre-selected order, thereby ensuring that, for example, the "grand" prize is awarded at an appropriate time during the sweepstakes. Whichever alternative is selected, it is essential to program the sweepstakes processor to include a sweepstakes account, which keeps track of each prize so that only a predetermined number of prizes are awarded. The sweepstakes account can be programmed to track both cash awards and material awards.

It is envisioned that if cash awards are given, the operator of the sweepstakes may elect to instantaneously credit the winner's financial institution account, or if the ATM is being utilized, to immediately deliver the cash prize to the user at the ATM. If the award is not given immediately at the ATM, the transaction receipt is printed to indicate the award to the user.

When the game apparatus is used in conjunction with a network system, it is possible to arrange the components such that each financial institution is in control of its own separate sweepstakes-type game. It is also envisioned that a network-wide sweepstakes-type game could be conducted.

In areas where lottery games are permitted, the apparatus is designed to be utilized as a lottery machine. The components are substantially similar, although the user would be required to pay consideration for the change to enter the lottery sweepstakes. Preferably, a separate function key would be provided on the ATM or POS terminal whereby the user could designate an amount of money to be withdrawn from the user's financial institution account and applied toward the lottery. This separate sweepstakes key could also be used on the standard sweepstakes-type game to increase user awareness. The sweepstakes computer is then programmed to accommodate either an instantaneous lottery determination or to enter the user's account number or other user indicia into a longer term lottery, as is well known in the art.

An alternative participation system is provided for non-account holders to participate in the game. In certain states, the charges associated with using a debit card could be considered to constitute a lottery-type situation. In that event, an alternate non-customer access means is provided whereby the presumption of consideration is defeated, so long as no charge is made for the alternative participation means. For example, a special sweepstakes card can be produced, which allows access only to the sweepstakes processor. Alternatively, the non-customer can be allowed to participate by requesting a playing card having special game indicia thereon for game play.

Additionally, other remote interface devices such as telephones, personal computers and electronic cash registers (ECR) are utilized for financial transactions, whereby the user has more flexibility in location when contacting the financial services-type institution.

In states where lottery games are legal, the financial institution can modify its sweepstakes processor to purchase electronically lottery chances, or tickets, for the user, and give the ticket as a prize for periodic use of the remote interface device. Appropriate security measures, including a "buffer" lottery-type game financial account, will be necessary to ensure the integrity of the state-sponsored lottery. The present invention also provides confirmation means, such as an assigned confirmation number, which is given to the user and stored by the lottery computer, for further security.

In another embodiment of the present invention, the remote interface device (e.g. ATM, POS device, ECR or analogous devices such as a telephone or personal computer in electronic communication with the financial services-type institution) is used to effect the purchase of a lottery ticket. Again, the lottery computer preferably issues a set of confirmation numbers and records them in addition to relaying them to the sweepstakes processor and the user, for security and fraud-prevention purposes.

Whether the lottery chance is awarded to, or purchased by, the user, money is transferred electronically from the financial institution to a lottery account. If a user-purchase is involved, the user's financial account is instantaneously debited. However, the money may be transferred to an account controlled by the financial services-type institution and held for periodic transfer to the lottery account on a daily or weekly basis. The same is true if the lottery ticket is given as a prize; the money is periodically batch transferred to the lottery account.

The drawings constitute a part of this specification and include exemplary embodiments of the present invention and illustrate various objects and features thereof.

DETAILED DESCRIPTION OF THE INVENTION

Figure 1:
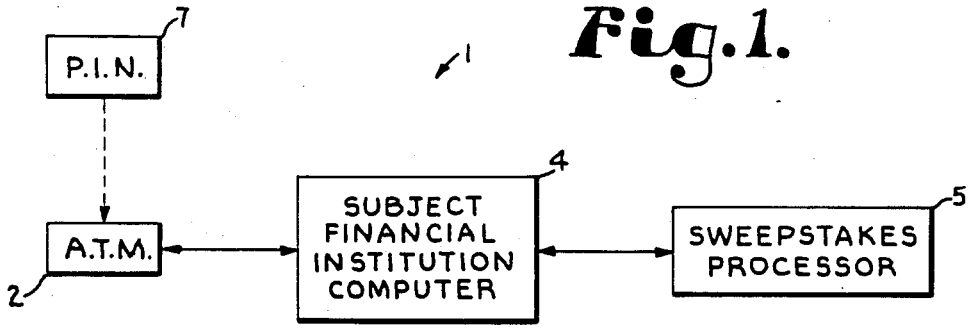
FIG. 1 is a simplified block diagram of the principal components employed for practicing an automated sweepstakes game according to the present invention, and showing an automated teller machine.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 generally indicates an automated sweepstakes game apparatus. An interface device, for example, an automated remote computer terminal such as an automated teller machine (ATM) 2, electronically communicates with a subject financial institution data processor or computer 4. A sweepstakes processor or computer 5 is in electronic communication with the subject financial institution computer 4 and the ATM 2. Typically, a user or player (not shown) gains access to the ATM 2 by inserting an identification card (not shown) and in addition (or instead of), by entering a personal identification number (PIN) 7.

Processor means such as the sweepstakes processor 5 reads a user indicia (not shown) such as a user's financial institution account number. The sweepstakes processor 5 generates a game indicia, such as a random prize number (not shown), and compares the user indicia and game indicia to determine whether a selected winning correlation exists between them.

The sweepstakes processor 5 relays the correlation information to the ATM and a printed receipt is given to the user, which indicates the absence or presence of the winning correlation. If a winning correlation exists, the sweepstakes processor 5 determines a prize (not shown) to be awarded a user as well as a manner of awarding the prize to the user.

Figure 2:
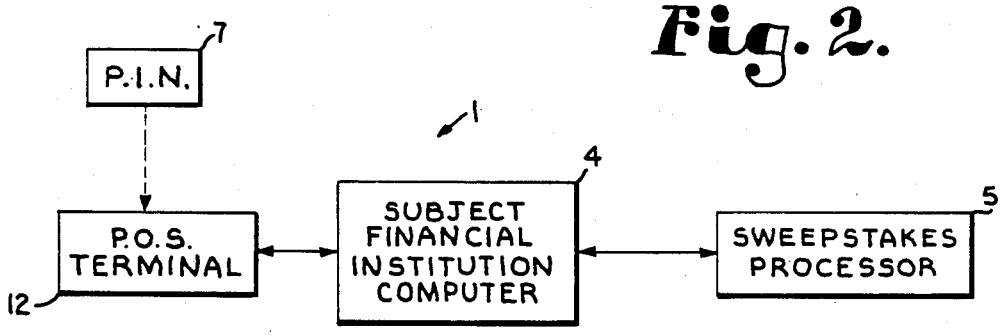
FIG. 2 is a view similar to FIG. 1 and illustrates a point-of-sale terminal in lieu of an automated teller machine.

As shown in FIG. 2, the remote computer terminal may be what is commonly known as a point-of-sale (POS) terminal 12 of the type located in a retail establishment for direct debiting of a user's financial institution account. The ATM 2 and POS terminal 12 are analogous machines, although not interchangeable. The functions of these machines are well known in the art and they will be discussed together, except where significant differences between them affect the present invention. Thus, in FIGS. 3 through 6, the POS terminal 12 could be substituted for the ATM 2. Furthermore, it is noted that a plurality of such ATM's 2 and POS terminals 12 are generally associated with a subject financial institution computer 4.

Typically, the user is provided a debit card (not shown) having a magnetically encoded stripe thereon. The debit card is adapted to be inserted into the ATM 2 and identifies the user to the subject financial institution computer 4. The PIN 7 is also used as an identification means for further validating the user's access to the subject financial computer 4. The user has an account number with the subject financial institution 4 that is specific to the user, and preferably comprises the user indicia for the present invention.

It is envisioned that the type of card known as a bank credit card could be used in lieu of the debit card, with no effect on the present invention. Further, the user indicia, in addition to comprising the user's financial institution account number (such as a checking account number), the user indicia could take the form of a number specifically assigned to the debit or credit card. It is also envisioned that the user indicia can comprise the transaction number or other number that identifies the user sufficiently to properly credit the user should he or she win the sweepstakes.

The user indicia, such as the financial institution account number, typically comprises approximately 10 digits, although the identifier can comprise alphanumeric characters. In any event, the sweepstakes processor 5 generates the game indicia such that the game indicia generally corresponds to the format of the user indicia. That is, if the user indicia comprises an account number having ten digits, the game indicia generated by the sweepstakes processor 5 would typically have ten digits.

Figure 3:
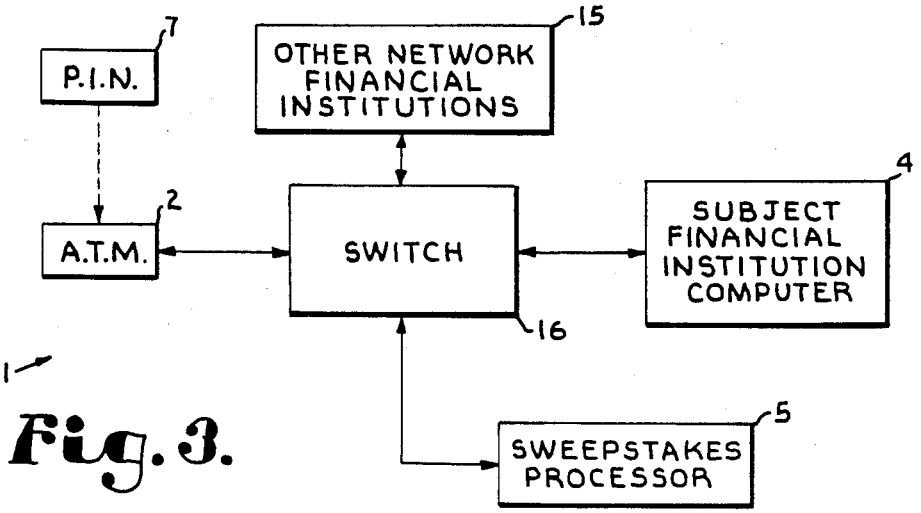
FIG. 3 is a simplified block diagram of the principal components of the automated sweepstakes game further showing a network system.
Figure 4:
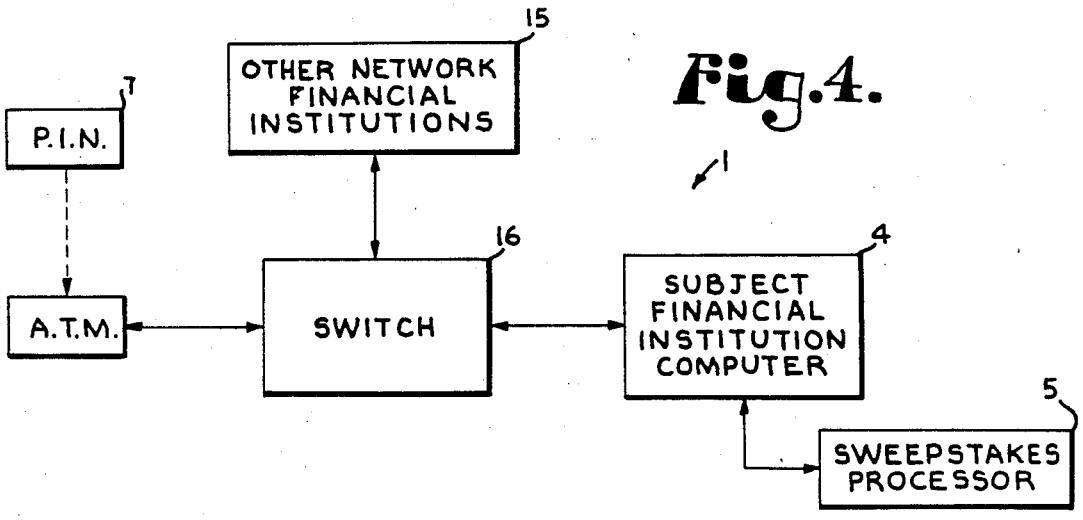
FIG. 4 is a view similar to FIG. 3 showing a first alternative arrangement of the principal components and network system.

FIGS. 3 through 6 disclose alternative configurations of the present invention, which configurations include a network of financial institutions 15 and a transmission facilities device, such as a switch 16. As illustrated in FIG. 3, the switch 16 receives an electronic communication from the ATM 2 and routes the financial institution instructions to the subject financial institution computer 4. The sweepstakes information, i.e. the user indicia, is routed to the sweepstakes processor 5 for comparison to a game indicia. As illustrated in FIG. 4, the financial institution information and the user indicia are routed to the subject financial instition computer 4. The user indicia is then routed to the sweepstakes computer 5 for further activity.

Upon completion of the data processing associated with the present invention, the information is relayed back to the switch 16. The results are routed by the switch 16 to the ATM 2 and the subject financial institution 4 for notification of the user, as seen in FIG. 3. As illustrated in FIG. 4, the results are first routed to the subject financial institution 4 and subsequently to the switch 16 for routing to the ATM 2.

Figure 5:
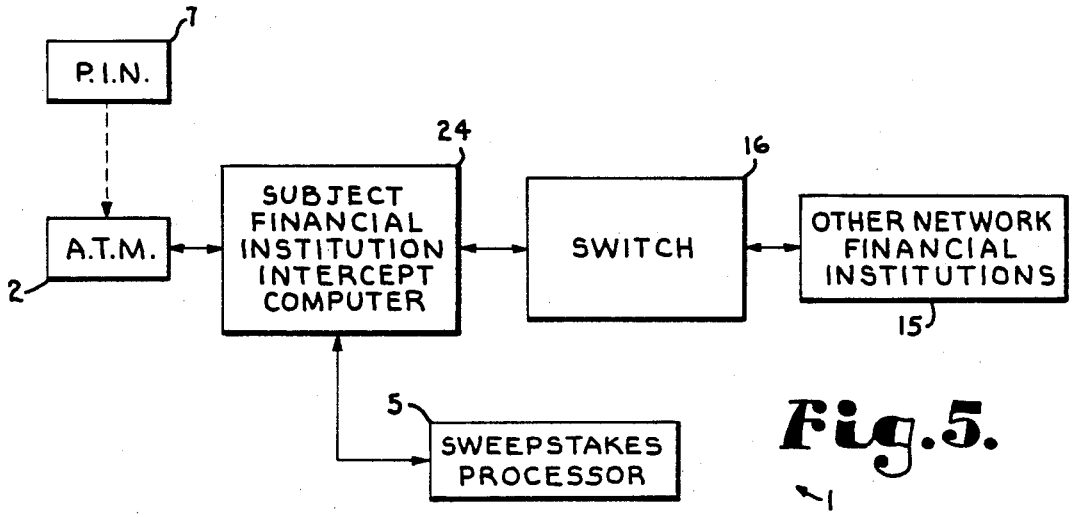
FIG. 5 is a view similar to FIG. 3 showing a second alternative arrangement of the principal components and network system.
Figure 6:
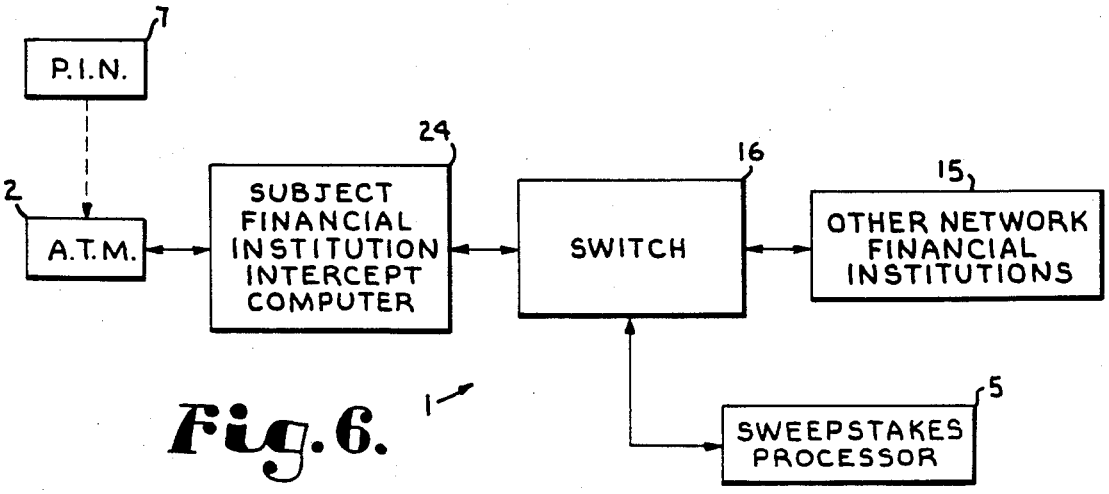
FIG. 6 is a view similar to FIG. 3 showing a third alternative arrangement of the principal components and network system.

As shown in FIGS. 5 and 6, the subject financial institution may place what is commonly known as an intercept computer 24 between the ATMs 2 associated with the financial institution and the switch 16. This positioning of the intercept computer 24 is commonly known as operating "in front of the switch", whereas the configurations disclosed in FIGS. 3 and 4 are known as operating "behind the switch". The intercept computer 24 "intercepts" communications from its associated ATMs 2 which are specific to the subject financial institution, while routing communications related to other network financial institutions 15 through the switch 16.

As shown in FIG. 5, the sweepstakes processor 5 is in direct communication with the intercept computer 24 and receives the user indicia information from the ATM 2 through the intercept computer 24 without routing to the switch 16.

As illustrated in FIG. 6, the sweepstakes processor 5 is in communication with the switch 16. Accordingly, user indicia relating to a customer of the subject financial institution is routed through the intercept computer 24 and switch 16 to the sweepstakes processor 5 and back again.

It is envisioned that the present invention can take a plurality of different configurations. As discussed in the Background of the Invention, the number of institutions comprising the network financial institutions 15 is very large. At present, network systems comprising in excess of 400 financial institution members are known, which together utilize in excess of a thousand automated teller machines.

The sweepstakes processor 5 as illustrated in FIGS. 3 through 6 can accommodate a number of different sweepstake alternatives. For example, the sweepstakes processor 5 can be adapted to accommodate an individual sweepstakes configuration for the subject financial institution alone. Alternatively, the sweepstakes processor 5 can be adapted to allow any user of any of the ATMs 2 in communication with the network of financial institutions 15 to participate in a single collective sweepstakes. It is further envisioned that a sweepstakes processor 5 could accommodate a plurality of individual financial institution sweepstakes.

Figure 7:
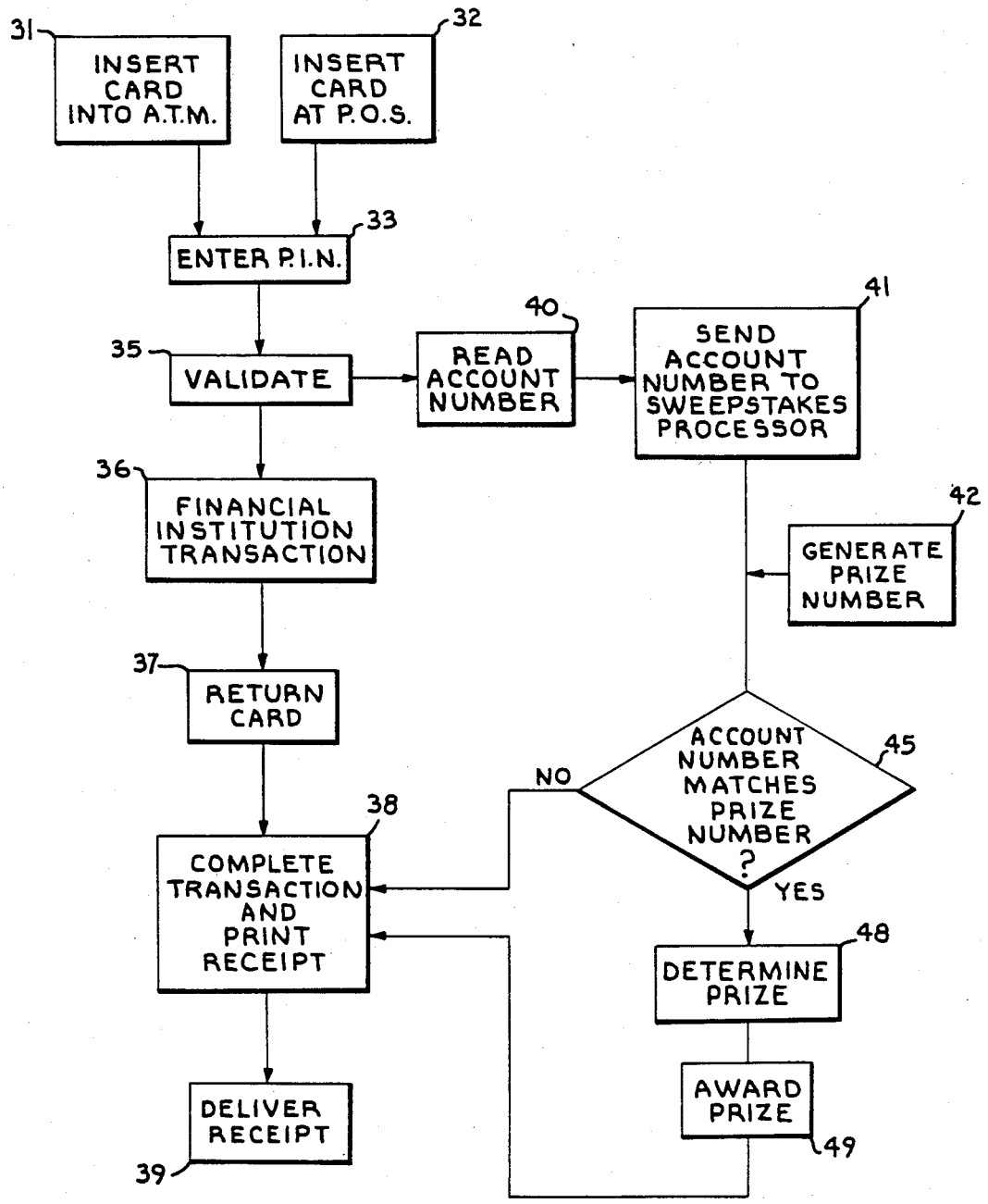
FIG. 7 is a flow chart representing the principal steps employed in practicing the automated sweepstakes game.

A preferred method of playing the sweepstakes-type game is disclosed in the flow chart of FIG. 7. Step 31 requires the insertion of an identification card, such as the previously described debit card in to an ATM 2. Alternatively, the user may insert the debit card or the like into a POS terminal 12, as shown at step 32. In either event, the deibt card begins the activation process and identifies the proposed user to the system. At step 33, the financial institution computer requires that the PIN 7 be entered on a keyboard (not shown) of the ATM 2 or POS terminal 12. The financial institution computer receives the informaation directly, or through the switch 16, as the case may be, and validates the PIN 7, provided the PIN 7 is in fact valid, as shown at step 35. Once validated, the user has access to his financial institution account and proceeds to conduct his financial institution transactions at step 36. As the user transacts his affairs with the financial institution at step 36, the sweepstakes computer reads the user's account number at step 40.

When the user has completed his transactions with the financial institution, at step 37 the card is returned to the user. At step 38, the financial transactions are completed (such as the delivery of withdrawn money) and the printing of a receipt. The receipt is delivered to the user at step 39. Alternatively, the card can be returned to the user following delivery of the receipt at step 39.

The account number is sent to the sweepstakes computer at step 41. The sweepstakes computer 5 generates, or has previously generated, a prize number or numbers as shown at step 42. The account number is compared to the prize number at step 45. The numbers are compared to determine whether a predetermined winning correlation exists between the numbers, that is whether they match. If no match exists, the game branches to step 38, and the negative results are printed on a receipt which is delivered to the user at step 39.

If the account and prize numbers match at step 45, the game branches to step 48, which determines the prize to be awarded to the user. The manner of awarding the prizes is determined at step 49. Steps 48 and 49 are discussed in greater detail below. From step 49, the game is directed to step 38 where the receipt is printed with the winning information, including the prize and manner of awarding same, and the receipt is delivered at step 39.

It is envisioned that numerous variations of the playing game method can be accommodated by the present invention. For example, the user indicia can be any appropriate number that is specific to the user, and it is not required that the user be a customer of the financial institution. In order to accommodate certain existing laws concerning lotteries, it is possible that non-customers would be allowed to enter the game.

The prize number generated at step 42 can be generated randomly prior to step 40, such that a winning prize number is determined perodically, as at the start of a business day or week. Alternatively, the prize number can be determined each time the game is played.

When a switch 16 is employed, with a collective sweepstakes among the network of financial institutions, a plurality of winning prize numbers can be generated and stored in the sweepstakes computer 5 to ensure that the prizes are distributed in an equitable manner. It is also envisioned that the prize to be awarded can be assigned to a pre-selected prize number, thus reducing the amount of computer time involved with each playing of the game.

The sweepstakes processor 5 has a prize account which records prizes as they are awarded and ensures that each prize is awarded only once. If the prize is to be cash, the prize account must have a cash balance therein which can be depleted as the prizes are awarded.

In awarding the cash prizes, the cash may be given out from the ATM at step 38, or simply credited to the user's financial institution account for later withdrawal. In the event the prize is a material good or service, an appropriate manner of awarding same is determined at step 49, such as instructing the user to go to his or her financial institution to receive the prize. The game may be played such that each participant receives some some of prize, such as a disconnect coupon for use at a local store.

In addition to notifying the user of the results of the sweepstakes by means of a printed receipt, it is also envisioned that the ATM 2 can be programmed to visually or vocally notify the user. That is, a special subroutine program could be provided to graphically demontrate the results om the ATM display screen, or to program a voice transmitter to so notify the user.

Present federal income tax laws require that a federal income tax withholding be effected on sweepstakes or gambling winnings in excess of $600. Thus, the sweepstakes processor 5 can be programmed to calculate and deduct the amount of such withholdings before awarding a cash prize.

ALTERNATIVE EMBODIMENTS

Figure 8:
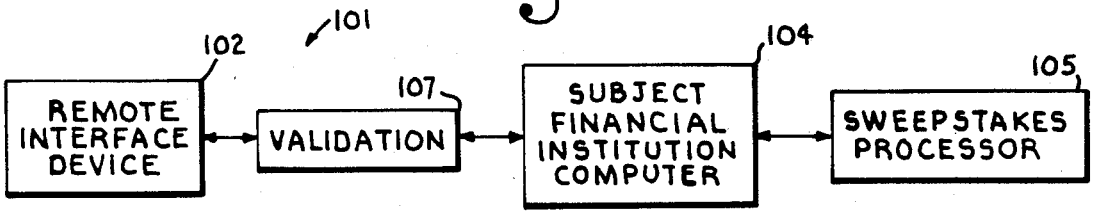
FIG. 8 is a simplified block diagram of the principal components employed in the instant invention and showing a generic remote interface device.
Figure 9:
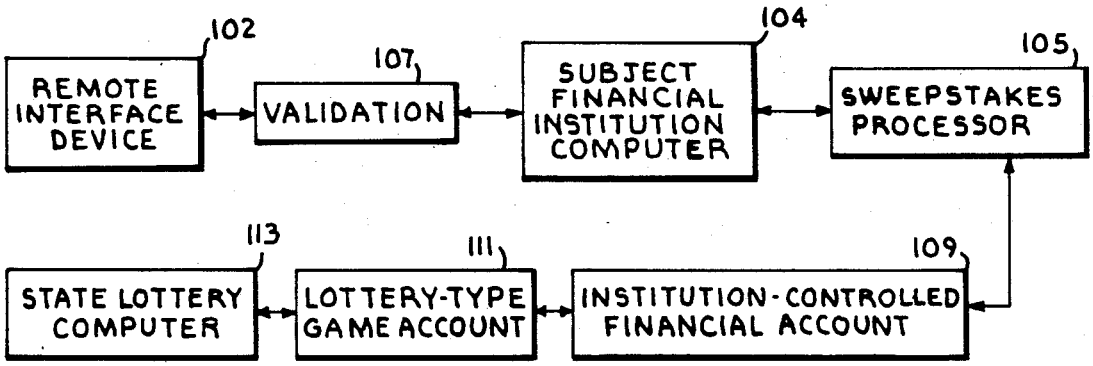
FIG. 9 is a simplified block diagram of the present invention and showing additional components utilized to award a lottery chance as a prize.
Figure 10:
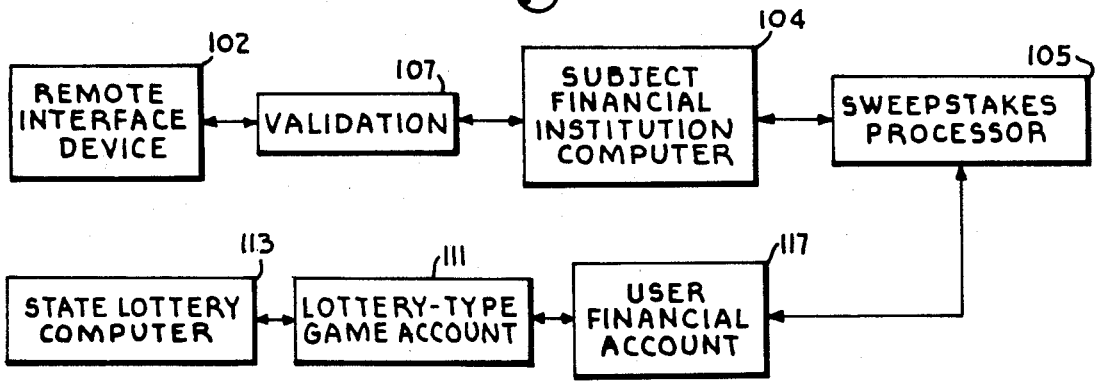
FIG. 10 is a simplified block diagram of an alternative embodiment showing the principal components necessary to allow a user to purchase a lottery ticket electronically.

FIGS. 8 through 10 illustrate additional related embodiments of the Automated Marketing and Gaming Systems. Specifically, FIG. 8 discloses a configuration generally analogous to the diagrams shown in FIGS. 1 and 2. The reference numeral 101 generally indicates an automated marketing and gaming system apparatus associated with a financial services-type institution.

A remote interface device 102 is in communication with a subject financial institution computer 104 having processor means, such as a sweepstakes processor 105. A validation block 107 is shown between the remote interface device 102 and the subject financial institution computer 104. The validation block 107 represents a step of identifying a user to the subject financial institution computer 104 and validating the user's access to his or her financial account at the subject financial institution. For example, a personal identification number (PIN) may be assigned to the user, which constitutes use identification means.

Means are provided for generating user indicia specific to the user and game indicia. The user indicia is passively generated without input from the user once access to the remote interface device 102 has been obtained.

The processor means, specifically the sweepstakes processor 105, communicates with the remote interface device 102 and receives the user indicia and game indicia (or generates either or both). The sweepstakes processor 105 compares the user indicia to the game indicia and determines whether a programmed winning correlation exists between them. Generally, the comparison of the user and game indicia is completed contemporaneously with the user effecting an unrelated financial transaction via the remote interface device 102. Thus, there is little or no appreciable extra time required to complete the game in addition to the time required for the unrelated financial transaction. The results of the comparison are then transmitted back to the remote interface device 102 and the user is notified of the results by an appropriate means.

The remote interface device 102 is of the type used by a financial services-type institution. In addition to the ATM and POS devices previously discussed, the term "remote interface device 102" contemplates a telephone or personal computer interface with the financial services-type institution. Components such as telephones and personal computers are essentially POS devices when used for banking purposes.

Various financial services-type institutions presently offer off-site transaction alternatives in addition to ATM and POS devices. Among these are banking by telephone and through personal computers. The present automated marketing and gaming system can be incorporated into such alternatives to encourage more financial services-type institution customers to utilize the services, thus making them more cost effective.

Telephone-based financial transactions rely on telephones that produce tone signals corresponding to numbers and other symbols on standard telephone sets. To initiate a telephone financial transaction, the user calls a telephone number that is associated with a subject financial institution computer 104, which has means for telephonic (electronic) communication with remote phone devices. Validation and identification are achieved by the user entering a PIN or the like by pushing appropriate buttons on the telephone, which buttons produce electronic signals that are received by the financial institution computer 104. Once access to the user's financial account is established, the financial transaction proceeds, with instructions to the subject financial institutin computer 104 being provided by the user pressing signal buttons, in a manner that is well-known in the art.

Generally contemporaneously with the user effecting the financial transaction, the sweepstakes processor 105 plays the automated sweepstakes-type game using indicia specific to the user as described for the initial embodiments. If desired, the user can be notified of the results of the sweepstakes at the ensd of his or her financial transaction. If a winning correlation exists, the user can be informed of the prize and details concerning the manner of awarding it, be it through a credit given to the financial account or through a physical claiming procedure. For security purposes a written confirmation can be mailed to the user.

The personal computer alternative is similar to the telephone sweepstakes, but with a different remote interface device 102. A personal computer can be utilized for home banking, with electronic phone communication effected through modems and the like, as is well-known in the art. A keyboard and screen associated with a standard personal computer provide the direct interface between the user and the subject financial institution computer 104. Identification and validation procedures are followed, and the user can effect various financial transactions, including directing payment of bills, transferring funds, and the like. The present invention is again used as an inducement to utilize the remote services, as with telephone banking. The automated sweepstakes-type game is played generally contemporaneously with the user effecting unrelated financial transactions. Results of the sweepstakes can be displayed on the user's screen, and if available, printed out by the user.

FIG. 9 illustrates a specific manner and type of a sweepstakes prize. The remote interface device 102, validation 107, and subject financial institution computer 104 are provided as discussed above. In this illustration, a lottery chance, or ticket, is given to the user of the remote interface device 102 as an incentive to use such device. To accomplish this, the sweepstakes processor 105, instead of conducting the usual game, is utilized to effect the purchase of a lottery chance from a government, especially a state, lottery institution.

An institution-controlled financial account 109, a lottery-type game account 111, and a state lottery computer 113 are shown schematically in FIG. 9. The institution-controlled financial account 109 is maintaind as a monetary fund controlled by the financial services-type institution. Money is deposited in the financial account 102 by the financial services-type institution for use in purchasing lottery chances. The sweepstakes processor 105 accesses the financial account 109 when a user utilizes the remote interface device 102 for a financial transaction. The sweepstakes processor 105 directs an electronic funds transfer (EFT) from the financial account 109 to the game account 111, whereby a lottery chance is purchased for the benefit of the user.

The game account 111 is maintained by the state lottery computer 113 and is provided as a security buffer between the state lottery computer 113 and the financial account 109. The sweepstakes processor 105 directs the electronic transfer of funds from the financial account 109 to the game account 111 in exchange for a lottery ticket. The transactions are recorded by both the sweepstakes processor 105 and the state lottery computer 113, with the financial account 109 and game account 111 being conduits for the transfer of money.

Although specific information regarding the user will be recorded with each transaction, the actual transfer of funds will typically occur on a periodic basis, such as daily or weekly. Thus, means are included for tracking the purchase of individual lottery chances, including: issuance and recording of a verification number by the state lottery computer 113, recording of such verification number by the sweepstakes processor 105, and notifying the user of the purchase on his or her account. It is envisioned that the lottery chance could be an instant-type game, or a lotto-type game (which would require substantially more record keeping). The sweepstakes processor 105 also records the frequency of use by the user and is programmed to limit the awarding of lottery chances to one per day, week, or the like. Thus, the user is given an inducement to use the remote interface device 102 through a passive, contemporaneous and random automatedl sweepstakes-type game.

Another modification is disclosed in FIG. 10, wherein reference numeral 117 indicates a user's financial account. In this embodiment, the remote interface device 102, which again is an ATM, POS device, telephone, personal computer, or the like, is utilized to purchase a lottery chance, or ticket.

The remote interface device 102 is used to access the subject financial institution computer 104, and commands are given by the user regarding the desire to buy one or more lottery tickets (instant, lotto-type, or the like). In order to keep this transaction generally separate from other financial services-type institution transactions, the sweepstakes processor 105 controls the purchanse steps. The user, having properly obtained access to the subject financial institution computer 104, chooses the type of lottery game he or she wants to enter and designates an amount of money to be transferred for this purpose. If a lotto-type game is chosen, numbers must be selected by the user or, alternatively, the sweepstakes processor 105 can be instructed to randomly generate numbers.

The sweepstakes processor 105 subsequently accesses the user's financial account 117 and transfers funds from it to the lottery-type game account 111. Alternatively, the funds transfer may be to a financial services-type institution holding account, which accumulates funds from multiple users and periodically batch transfers same to the lottery-type game account 111. Meanwhile, the user's information regarding lottery choice is entered and stored in the state lottery computer 113. Confirmation, e.g. by means of a confirmation number, is then issued by the state lottery computer 113 and relayed to the user via the sweepstakes processor 105. If desired, this confirmation can be stored in the sweepstakes processor 105 and a printed receipt can be given to the user. In the eent the user wins the lottery, the user's financial account 117 may automatically be credited with the proceeds, less any required tax withholding.

The crediting of the user's financial account 117 can be accomplished by various means. For example, the sweepstakes processor 105, upon a determination that a winning lottery ticket has been purchased by or for the user, can notify the state lottery computer 113 and request payment from the lottery-type game account. Once the winning correlation is confirmed, the proceeds are electronically transferred to the subject financial institution computer 104 for crediting to the user's financial account 117. Another example is for the winding correlation to be confirmed automatically and the proceeds credited directly to the user's financial account 117 from the state lottery computer.

It is to be understood that while certain forms of the present invention have been illustrated and described herein, it is not to be limited to the specific forms or arrangement of parts described and shown.

What is claimed and desired to be secured by Letters Patent is as follows:

1. Apparatus for participation of a user in a sweepstakes-type game, said apparatus comprising:

(a) a telephone device for allowing electronic communication between the user and a financial services-type institution;

(b) user identification means for providing user access to said financial services-type institution;

(c) means generating user indicia specific to the user; said user indicia being passively generated without input from said user once said user has obtained access to said financial services-type institution;

(d) means generating game indicia; and (e) processor means associated with said financial services-type institution and communicating with said telephone device, receiving said user indicia, and receiving said game indicia; said processor means including means for comparing said user indicia to said game indicia and determining whether a selected winning correlation exists between same, said processor means including means for completing the comparison of said user game indicia generally contemporaneously with the user effecting an unrelated transaction by means of said telephone device, whereby there is no appreciable extra time required to complete said game in addition to said unrelated transaction.

2. Apparatus for participation of a user in a sweepstakes-type game, said apparatus comprising:

(a) a personal computer for electronic communication between a user and a financial services-type institution;

(b) user identification means for providing user access to said financial services-type institution;

(c) means generating user indicia specific to the user; said user indicia being passively generated without input from said user once said user has obtained access to said financial services-type institution;

(d) means generating game indicia; and (e) processor means associated with said financial services-type institution and communicating with said personal computer, receiving said user indicia, and receiving said game indicia; said processor means including means for comparing said user indicia to said game indicia and determining whether a selected winning correlation exists between same, said processor means including means for completing the comparison of said user game indicia generally contemporaneously with the user effecting an unrelated transaction by means of said personal computer, whereby there is no appreciable extra time required to complete said game in addition to said unrelated transaction.

3. Apparatus for playing a sweepstakes-type game by a user, said apparatus comprising:

(a) a plurality of remote interface devices; each of said remote interface devices being in electronic communication with a financial institution data processing machine; each of said remote interface devices being one of an automated teller machine, a point-of-sale terminal, telephone device, electronic cash register or personal computer of the type used in financial transactions with a financial services-type institution;

(b) user identification means identifying a financial account associated with a user at said financial institution; each of said remote interface devices including means for allowing said user to access electronically the financial institution account of said user;

(c) a sweepstakes data processor having means for passively reading an account number associated with said user's financial account without input from the user and means for generating a random number and comparing said account number to said random number while the user effects a transaction at said remote interface device, said comparing of said account number and said random number being effected to determine whether said account number and random number match, whereby there is no appreciable additional time required to complete said game in addition to said transaction; and (d) said sweepstakes data processor including means for determining a prize to be awarded to the user of an account number determined to match said random number and awarding said prize to the user.

4. The apparatus as set forth in claim 3 wherein:

(a) said sweepstakes data processor includes means for awarding said prize to the user by transferring prize funds to said user's financial account and notifying the user through one of said remote interface devices of the prize and transfer of prize funds.

5. The apparatus as set forth in claim 3 wherein:

(a) said sweepstakes data processor includes means for awarding said prize by dispensing prize funds at one of said remote interface devices when said one remote interface device is one of said automated teller machines or point-of-sale devices.

6. A method of playing a sweepstakes-type game including the steps of:

(a) entering a user identifier into a remote interface device; said interface device being one of an automated teller machine, a point-of-sale terminal, a telephone, an electronic cash register or a personal computer of the type used by a financial services-type institution;

(b) accessing a financial account at a financial services-type institution electronically through the interface device upon entry of said user identifier;

(c) passively assigning user indicia specific to said user without prompting from said user;

(d) selecting a random game indicia;

(e) reading said user indicia and said game indicia;

(f) comparing said user indicia to said game indicia;

(g) determining whether a winning correlation exists between said game indicia and said user indicia;

(h) awarding a selected prize to said user upon determining that said selected winning correlation exists;

(i) notifying said user of whether a selected winning correlation exists at generally the same time that said user completes an unrelated transaction with the financial institution; and (j) awarding said prize to the user by contemporaneously crediting said user's financial account at said financial services-type institution.

7. Apparatus for promoting the use of remote interface devices for making financial transactions, said apparatus comprising:

(a) a remote interface device of the type provided by financial services-type institutions for effecting financial transactions between at least one of said institutions and a user;

(b) said interface device being one selected from the group consisting of a telephone, a point-of-sale device, an automatic teller machine, an electronic cash register and a personal computer;

(c) user identification means providing user access through said interface device to said institution;

(d) means providing a financial account under the control of the institution, said financial account being funded for promoting the frequent use of said interface device;

(e) means for providing a lottery-type game account adapted to electronically receive funds paid for lottery chances;

(f) means communicating with said interface device and adapted to electronically effect the transfer of funds out of said institution-controlled financial account and into said lottery-type game account, said electronic transfer to said lottery-type game account occurring without input by said user other than said user effecting at least one separate financial transaction with said institution through operation of said interface device; and (g) further means communicating with said interface device and adapted to notify said user that a lottery chance has been purchased by said institution on behalf of said user.

8. The apparatus as set forth in claim 7 wherein:

(a) said further means communicating with said interface device includes means for providing said user with printed evidence of said lottery chance.

9. The apparatus as set forth in claim 7 wherein:

(a) said means effecting the electronic transfer into said lottery-type game account includes means for causing the transfer contemporaneously with said separate financial transaction.

10. The apparatus as set forth in claim 7 wherein:

(a) said means effecting the electronic transfer into said lottery-type game account includes means for causing the transfer non-contemporaneously with said separate financial transaction.

11. The apparatus as set forth in claim 7 wherein:

(a) said means effecting the electronic transfer into said lottery-type game account includes means for storing information relating to the number of lottery chances purchased on behalf of remote interface device users and means for subsequently electronically batch transferring corresponding funds into said lottery-type game account.

12. The apparatus as set forth in claim 7 further including:

(a) means for notifying said lottery-type game account that said lottery chance purchased on behalf of the user is a winning lottery chance and effecting the transfer of winning proceeds from said lottery-type game account to said institution-controlled financial account for distribution to the user.

13. The apparatus as set forth in claim 7 further including:

(a) means for automatically confirming the existence of a winning correlation and crediting the user's financial account with lottery proceeds from said lottery-type game account.

14. The apparatus as set forth in claim 7 wherein:

(a) said means communicating with said interface device includes means for storing user identification indicia obtained from said user identification means and means for comparing said indicia with identification indicia obtained from a later user;

(b) said means communicating with said interface device having means operative to block the purchase of a lottery chance on behalf of the later user upon finding a match between said respective indicia; and (c) including means for preventing a particular user from repeatedly obtaining lottery chances purchased by said institution.

15. Apparatus for marketing lottery chances comprising:

(a) a remote interface device of the type provided by financial services-type institutions for effecting financial transactions between at least one of said institutions and a user;

(b) said interface device being one selected from the group consisting of a telephone, a point of sale device, an automatic teller machine, an electronic cash register and a personal computer;

(c) user identification means providing user access through said interface device to one of said institutions;

(d) means providing a financial account under the control of the user;

(e) means providing a lottery-type game account for electronically receiving funds thereinto;

(f) means communicating with said interface device and including means for electronically effecting the transfer of funds out of said financial account and into said lottery-type game account; and (g) further means communicating with said interface device for notifying said user that a lottery chance has been purchased by said user.

16. The apparatus as set forth in claim 15 wherein:

(a) said further means communicating with said interface device includes means for providing said user with printed evidence of said lottery chance.

17. The apparatus as set forth in claim 15 wherein:

(a) said means effecting the electronic transfer into said lottery-type game account is adapted to store information relating to the number of lottery chances purchased on behalf of remote interface device users in a lottery player information repository and subsequently electronically batch transfer corresponding funds into said lottery-type game account.

18. Apparatus for distributing lottery chances comprising:

(a) a remote interface device of the type provided by financial services-type institutions for effecting financial transactions between at least one of said institutions and a user;

(b) said interface device being one selected from the group consisting of a telephone, a point of sale device, an automatic teller machine, an electronic cash register and a personal computer;

(c) user identification means providing user access through said interface device to one of said institutions;

(d) means providing a financial account under the control of the user;

(e) means providing a lottery-type game account including means for electronically receiving funds thereinto;

(f) means providing a lottery player information repository;

(g) means communicating with said interface device and including means for receiving and recording in said repository a set of lottery numbers assigned to the user and means for electronically effecting the transfer of funds out of said financial account and into said lottery-type game account; and (h) further means communicating with said interface device and including means for notifying said user that a lottery chance associated with said lottery numbers has been issued.

19. The apparatus as set forth in claim 18 wherein:

(a) said further means communicating with said interface device including means for providing said user with a printed lottery ticket bearing said lottery numbers.

20. A method for promoting the use of remote interface devices for making financial transactions including the steps of:

(a) entering a user identifier into a remote interface device for effecting financial transactions between a user and a financial services-type institution; one of said remote interface devices being one selected from the group consisting of a telephone, a point-of-sale device, an automated teller machine, an electronic cash register and a personal computer;

(b) accessing a user's financial account at said financial services-type institution electronically through said remote interface device upon entry of said user identifier;

(c) providing an institution-controlled financial account funded for promoting the use of said remote interface device;

(d) providing a lottery-type game account for electronically receiving funds paid for lottery chances; and (e) electronically transferring funds from said institution-controlled financial account to said lottery-type game account for periodically purchasing a lottery chance for the user without input therefrom upon the user effecting a financial transaction with said financial services-type institution through operation of said remote interface device.

21. The method as set forth in claim 20 further including the step of:

(a) notifying the user that a lottery chance has been purchased by said financial services-type institution on behalf of said user.

22. A method of marketing lottery chances including the steps of:

(a) entering a user identifier into a remote interface device for effecting financial transactions between a user and a financial services-type institution; said remote interface device being one selected from the group consisting of a telephone, a point-of-sale device, an automated teller machine, an electronic cash register and a personal computer;

(b) accessing a user's financial account at said financial services-type institution electronically through said remote interface device upon entry of said user identifier;

(c) providing a lottery-type game account for electronically receiving funds paid for lottery chances;

(d) transferring electronically funds from said user's financial account to said lottery-type game account to purchase a lottery chance upon instructions from said user by means of said remote interface device; and (e) notifying said user that a lottery chance has been purchased by said user.

23. The method as set forth in claim 22 further including the steps of:

(a) determining whether the user's lottery chance is a winning ticket;

(b) notifying said lottery-type game account of the existence of a winning ticket;

(c) requesting transfer of winning proceeds of the winning ticket from said lottery-type game account to said financial services-type institution;

(d) crediting the user's financial account at said financial services-type institution with said winning proceeds; and (e) notifying the user of the existence of said winning ticket and the crediting of the user's financial account.

24. The method as set forth in claim 22 further including the steps of:

(a) automatically confirming the existence of a winning lottery ticket; and (b) automatically crediting the user's financial account with proceeds from the winning lottery ticket.

25. A method of stimulating the use of remote interface devices by playing a sweepstakes-type game including the steps of:

(a) generating prize winning indicia;

(b) entering a user identifier into a remote interface device; said interface device being one of an automated teller machine, a point-of-sale terminal, a telephone, an electronic cash register or a personal computer of the type used in conducting transactions with a financial services-type institution;

(c) accessing a financial account in said financial services-type institution electronically through the interface device upon entry of said user identifier;

(d) passively generating indicia for the user;

(e) comparing said passively generated indicia to said prize indicia; and (f) determining whether a winning correlation exists between said passively generated indicia and said prize indicia at generally the same time that said user conducts an unrelated transaction with said financial services-type institution.

26. The method as set forth in claim 25, including the step of:

(a) awarding as a prize one of cash, a credit to said financial account, a discount coupon or instructions for redeeming a material good or service.

27. Apparatus for playing a sweepstakes-type game comprising:

(a) a plurality of remote interface devices; each of said remote interface devices being capable of electronic communication with a financial services-type institution data processing machine; each of said remote interface devices being one of an automated teller machine, a point-of-sale terminal, a telephone, electronic cash register or personal computer of the type used in conducting transactions with said financial services-type institution;

(b) user identification means identifying a financial account associated with a user at said financial services-type institution; each of said remote interface devices including means for allowing said user to electronically access the financial services-type institution account of said user;

(c) means for generating winning prize indicia;

(d) means for passively generating indicia for the user;

(e) means for comparing said passively generated indicia to said winning prize indicia approximately while the user effects an unrelated transaction with said financial services-type institution at one of said remote interface devices, said means for comparing being operable to determine whether a winning correlation exists between said prize indicia and said passively generated indicia over an interval requiring no appreciable additional time beyond that required to complete said transaction.

28. The apparatus as set forth in claim 27, including:

(a) means for awarding as a prize one of cash, a credit to said financial account, a discount coupon or instructions for redeeming a material good or service.

29. A method of stimulating the use of remote interface devices by playing a sweepstakes-type game including the steps of:

(a) generating prize winning indicia;

(b) entering a user identifier into a remote interface device; said interface device being one of an automated teller machine, a point-of-sale terminal, a telephone, an electronic cash register or a personal computer of the type used in conducting transactions with a financial services-type institution;

(c) accessing a financial account in said financial services-type institution electronically through the interface device upon entry of said user identifier;

(d) generating indicia for the user;

(e) comparing said user generated indicia to said prize indicia; and (f) determining whether a winning correlation exists between said user generated indicia and said prize indicia contemporaneously with the user effecting an unrelated financial transaction via said remote interface device.

* * * * *